United States Patent [19]

Hewitt et al.

[11] 3,957,430

[45] May 18, 1976

[54] PROCESS FOR THE COLOURATION OF ACRYLIC FIBRES

[75] Inventors: Brian Hewitt, Crewe; Cyril Hobday, Manchester; James Jack, Bramhall; John Francis Edmund Keenan, Cheadle, all of England

[73] Assignee: Ciba-Geigy Corporation, Ardsley, N.Y.

[22] Filed: Jan. 15, 1975

[21] Appl. No.: 541,190

[30] Foreign Application Priority Data

Jan. 18, 1974 United Kingdom ..... 2468/74

[52] U.S. Cl. ..... 8/172 R; 8/83; 8/177 R

[51] Int. Cl.[2] ..... D06P 5/06

[58] Field of Search ..... 8/172, 177 R, 83

[56] References Cited

UNITED STATES PATENTS

| | | | |
|---|---|---|---|
| 3,493,981 | 2/1970 | Noda et al. | 8/172 |
| 3,565,572 | 2/1971 | Schneider et al. | 8/172 X |
| 3,812,108 | 5/1974 | Brack et al. | 8/177 R X |

*Primary Examiner*—Lewis T. Jacobs

*Attorney, Agent, or Firm*—Joseph G. Kolodny; Edward McC. Roberts; Prabodh I. Almaula

[57] ABSTRACT

A process for the colouration of polyacrylonitrile textile fibres, wherein said fibres are coloured by printing or pad-steaming with a cationic dye in the presence of a carrier consisting of least one compound having the formula

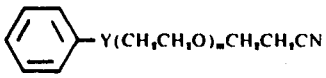

$$Y(CH_2CH_2O)_mCH_2CH_2CN \quad (1)$$

in which Y is an oxygen or sulphur atom and *m* is a number from 1 to 2, obtaining on said fibres a rapid fixation of the cationic dye and a high colour yield.

14 Claims, No Drawings

PROCESS FOR THE COLOURATION OF ACRYLIC FIBRES

The present invention relates to a new and improved process for the printing and pad-steaming of acrylic fibres.

In British Pat. Specification No. 1,285,983 there is described a process for the printing or pad-steaming of polyacrylonitrile fibres in the presence of dyeing assistants having the formula $$R-(OCH_2CHX)_n-OH$$

wherein R is a phenyl or chloro-substituted phenyl grouping, X is hydrogen or a methyl group and *n* is an integer from 1 to 3. An example of such a dyeing assistant is monochlorophenoxyethanol which is used in the successful commercial printing of polyacrylonitrile fibres. There is now a requirement for a dyeing assistant which enables even higher colour yields of dyestuffs to be obtained in printing and pad-steaming processes.

According to the present invention there is provided a process for colouring polyacrylonitrile fibres which comprises printing or pad-steaming said fibres with a cationic dye in the presence of a compound or mixture of compounds having the formula:

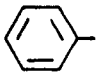

$$-Y-(CH_2CH_2O)_mCH_2CH_2CN \qquad (1)$$

in which Y is an oxygen or sulphur atom and *m* is a number from 1 to 2.

The compositions used in the process are also within the scope of the invention.

When the compounds of formula (1) are prepared a mixture may be obtained which comprises some compounds in which *m* is 1 and some compounds in which *m* is 2. It is understood therefore, that *m* may be an average value between 1 and 2, for instance from 1 to 1.9. In this event Y is preferably an oxygen atom and *m* has advantageously an average value of from 1 to 1.5.

Especially satisfactory results of broad application to a great variety of dyestuffs are obtained with those compounds of formula (1) wherein *m* is 1 or 2.

Examples of compounds of formula (1) are 3-(2'-phenoxyethoxy)propionitrile, 3-[2'-(2''-phenoxyethoxy)-ethoxy]propionitrile and 3-[2'-(phenylthio)ethoxy]propionitrile.

The amount of the compound having the formula (1) may conveniently be within the range of from 0.5% to 10% by weight and preferably from 1% to 5% by weight, based on the total weight of the print paste or the total weight of the pad liquor.

Particularly advantageous results are obtained when the colouration of the polyacrylonitrile fibres is carried out by a printing process.

The acrylic fibres, which may be coloured by the process of the present invention include the commercially known types of polymeric or copolymeric acrylonitrile. In the case of acrylonitrile copolymers, the proportion of acrylonitrile is advantageously of at least 80 per cent by weight, based on the weight of the copolymer. Furthermore, these acrylic fibres possess sufficient dyesites to impart to the fibres a color saturation value of at least 1 and especially in the range of about 1.1 to 3.5. Suitable conomers include other vinyl compounds, e.g. vinylidene chloride, vinylidene cyanide, vinyl chloride, methacrylate, methylvinylpyridine, N-vinylpyrrolidone, vinylacetate, vinylalcohol or styrenesulphonic acid.

The acid groups of copolymer effecting the affinity of the dyestuff are mainly the carboxylic acid, carboxylic acid amide or hydroxy groups as well as the sulphonic acid group.

Commercially available fibres of the above-described type are stated, for example, in the publication of R. Rokohl, Tenside 2 (1965), 76 "Kationtenside als Egalisiermittel fur das Farben von anionischen Polyacrylnitrilfasern" and include for instance Dralon, Orlon 42, Acrilan 16 or Courtelle.

Suitable materials comprising polyacrylonitrile fibres that may be coloured by the process of the present invention include carpet and other floor coverings such as needle felt, carpet yarns, yarns for other uses, for example woven fabrics and fibre assemblies such as tow and slubbing.

The cationic dye that may be used in the present invention may conveniently be one containing ammonium, sulphonium or phosphonium groups.

For instance, the usual salts of cationic dyestuffs, e.g. the halides, sulphates, alkyl sulphates, aryl sulphonates or especially metal halide double salts such as zinc chloride double salts, of a wide variety of cationic dyestuffs may be used. In particular, salts of methine, azamethine or especially cyclammonium polyazamethine dye salts, cycloammonium azo dye salts or cyclammonium triazene dye salts may be used. Alternatively, basic dyestuffs of the diphenylmethane, triphenylmethane, oxazine or thiazine series may also be used according to the present invention. As a further alternative, basic dyestuffs of the arylazo or anthraquinone series having an external ammonium group, for example an alkylammonium or pyridinium group and the benzo-1, 2-pyrane dye salts containing a cyclammonium group, especially a benzimidazolium group, may be used.

Particularly suitable in the printing or pad-steaming process according to the invention is the use of cyclammonium azo dye salts corresponding to the formula $$[A-N=N-B]^+An^- \qquad (2)$$

The symbols in this formula have the following meanings:

A represents the radical of an optionally benzo-condensed N-quaternised azole or azine ring, preferably a thiazolium, benzthiazolium, imidazolium, benzimidazolium, pyridinium, quinolinium, pyrazolium, indazolium, triazolium or thiadiazolium radical, B represents the radical of a coupling component free of hydroxyl groups in the nucleus and enolisable keto groups, especially a p-aminophenyl radical or -naphthyl radical, a 3-indazolyl, 3-indolyl, 2,4,6-triamino-5-pyrimidyl or 5-amino-4-pyrazolyl radical, and $An^-$ represents the anionic acid equivalent.

The amount of dye that is used may vary depending on the circumstances, for example, the depth of shade required, and may be an amount up to 10% by weight based on the weight of printing paste or pad liquor.

The colouration is carried out by applying out the colour at a temperature below the fixation temperature of the dyestuff, preferably at ambient temperatures, followed by steaming and afterwards washing and drying. The print paste or pad liquor may contain the other dyeing auxiliaries normally used.

Where the colouration is carried out by a printing process, a printing paste is applied by a conventional method for instance by means of rotary or flat screens or by a Vigoreux or other printing machine. The paste may contain the usual components in addition to the dyestuff, there is, for example a wetting agent and a thickening agent such as an alginate, gum traganth, etherified maize starch, crystallized rubber or British rubber or some other mucilage. Other possible thickening agents are described in the book "Printing of Textiles" by Walter Bernard, published by Springer, Berlin, Heidelberg, New York 1969.

The steaming may be carried out at a temperature up to 120°C, and preferably from 100°C to 110°C for instance by using saturated or slightly superheated steam at atmospheric pressure. If desired a pressure of up to 0.5 atmospheres higher than atmospheric pressure may be used.

The steaming may be carried out for a varying period of time, for instance up to 2 hours in batchwise steaming. In continuous processing the steaming is carried out for much shorter periods of the order of 2 to 20 minutes.

After steaming the material may be washed thoroughly and dried by conventional methods.

The dyeing assistants used in the process of this invention are superior to other closely related compounds with only minor differences in chemical structure particularly with regard to wash fastness.

The following Examples further illustrate the present invention. Percentages and parts are expressed by weight.

EXAMPLE 1

A print paste is prepared from a. 600 parts 4% locust bean gum ether
b. 5 parts of a dyestuff having the formula:

c. 10 parts 80% acetic acid.
d. 15 parts 3-(2'-phenoxyethoxy)propionitrile and made up to 1000 parts with water.

The above paste is applied by screen printing to acrylic carpets at 15°C with an add-on of 300% and then steamed at 100°C for 5 minutes. The printed carpet is then washed thoroughly in cold water and dried. A well defined print in a full red shade is obtained with no staining on adjacent white carpet. The wash off liquor contains a negligible quantity of colour.

EXAMPLE 2

By following a similar procedure to that described in Example 1 but using 5 parts of a dyestuff having the formula

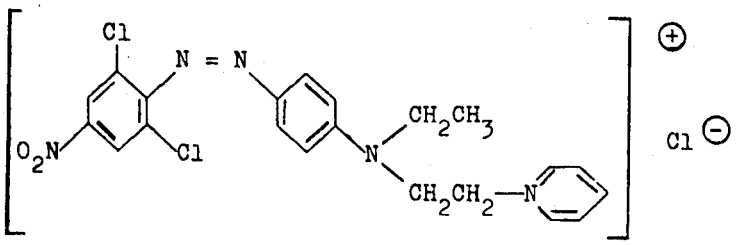

(4)

instead of (*b*), a well defined print in a full yellow brown shade is obtained with no staining on adjacent white carpet. The wash off liquor contains a negligible quantity of colour.

EXAMPLE 3

A print paste is prepared from a. 600 parts 4% locust bean gum ether
b. 5 parts of a dyestuff of formula (3)
c. 10 parts 80% acetic acid
d. 30 parts 3-[2'-(2''-phenoxyethoxy)ethoxy]propionitrile.

The above paste is applied by screen printing to acrylic carpet at 15°C with an add-on of 300% and steamed at 100°C for 5 minutes. The printed carpet is then washed thoroughly in cold water and dried. A well defined print in a full red shade is obtained with no staining on adjacent white carpet. The wash off liquor contains a negligible quantity of colour.

EXAMPLE 4

By following a similar procedure to that described in Example 3 but using 30 parts of 3-[2'-(phenylthio)ethoxy]propionitrile instead of component (*d*) and a dyestuff having the formula (3)

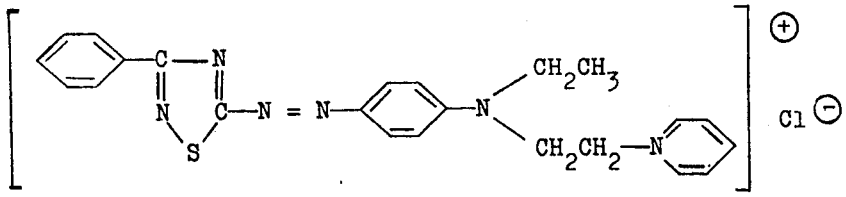

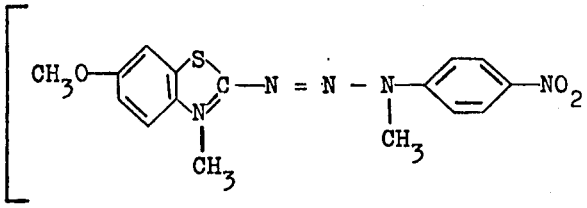

(5)

a well defined print in a full yellow shade is obtained with no staining on adjacent white carpet. The wash off liquor contains a negligible quantity of colour. The 3-[2'-(phenylthio)ethoxy]propionitrile used as printing assistant in the above Example 4 is prepared as follows: 15.4 g 2-(phenylthio)ethanol and 0.3 g of a concentrated aqueous mixture of sodium and potassium hydroxides are stirred at room temperature and treated with 6.0 g acrylonitrile over a period of 2 hours. The temperature is not allowed to rise above 42°C. After the addition, stirring is continued for a further 2 hours. The alkaline catalyst is then neutralised with dilute sulphuric acid, the organic product is dissolved in ethyl acetate, washed with water, separated and dried over magnesium sulphate. The ethyl acetate is distilled leaving 18.3 g of 3-[2'-(phenylthio)-ethoxy]propionitrile.

Analysis: Measured: C = 63.96%; H = 6.37%; N = 6.75%; S = 15.38%. Calculated: C= 63.77%; H = 6.28%; N = 6.76%; S = 15.59%.

EXAMPLE 5

By following a similar procedure to that described in Example 1 but using a dyestuff having the formula

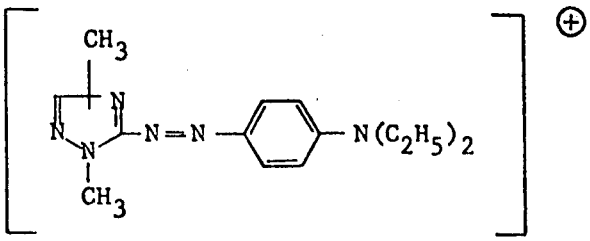

(6)

instead of the dyestuff there used a well defined print in a full red shade is obtained with no staining on adjacent white carpet. The wash off liquor contains a negligible quantity of colour.

EXAMPLE 6

By following a similar procedure to that described in Example 1 but using 30 parts of component (*d*) and a dyestuff having the formula

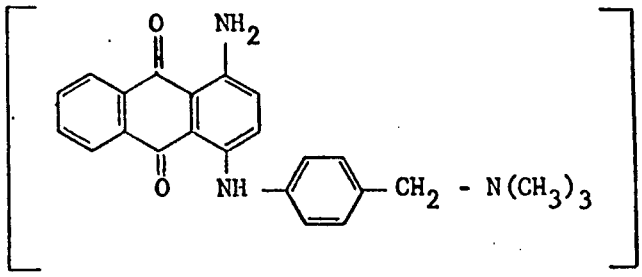

(7)

instead of the dyestuff there used a well defined print in a full blue shade is obtained with no staining on adjacent white carpet. The wash of liquor contains a negligible quantity of colour.

EXAMPLE 7

A pad dyeing is carried out on an acrylic double jersey fabric to give an application of 100% on the weight of the fibre.

The constitution of the pad-bath is as follows:

a. 200 parts of 3% locust bean gum ether
b. 10 parts of a dyestuff having the formula (4)
c. 10 parts of 80% acetic acid.
d. 20 parts of 3-(2'-phenoxyethoxy)propionitrile and made up to 1000 parts with water.

The acrylic fabric is steamed for 3 minutes at atmospheric pressure. The yield is excellent and the wash-off liquor contains a negligible quantity of colour.

EXAMPLE 8

A pad dyeing is carried out on an acrylic blanket in a similar manner to that described in Example 7. The yield is excellent and the wash-off liquor contains a negligible quantity of colour.

EXAMPLE 9

A slop-pad dyeing process is carried out on a carpet having a pile of polyacrylonitrile fibre to give an application of 100% on the weight of the fibres.

Th constitution of the pad-bath is as follows:

a. 100 parts 3% locust bean gum ether
b. 2.5 parts of a dyestuff having the formula (4)
c. 10 parts of 80% acetic acid
d. 20 parts of 3-(2'-phenoxyethoxy)propionitrile and made up to 1000 parts with water.

The carpet is steamed for 7 minutes at atmospheric pressure. The yield is excellent and the was-off liquor contains a negligible quantity of colour.

COMPARATIVE EXAMPLE

By repeating the procedure described in Example 1 but using 3-(2'-phenylethoxy)-propionitrile instead of component (*d*) there used, the wash off liquor contains considerable quantities of colour and there is appreciable staining on the adjacent unprinted acrylic carpet.

We claim:

1. A process for the colouration of polyacrylonitrile fibres which comprises printing or pad-steaming said fibres with a cationic dye in the presence of a carrier consisting of at least one compound having the formula

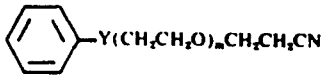

(1)

in which Y is an oxygen or sulphur atom and *m* is a number from 1 to 2.

2. A process as claimed in claim 1, wherein the polyacrylonitrile fibres are coloured by a printing process.

3. A process as claimed in claim 1, wherein Y is oxygen and *m* has an average value of from 1 to 1.5.

4. A process as claimed in claim 1, wherein *m* is 1 or 2.

5. A process as claimed in claim 1, wherein the compound of formula (1) is 3-(2'-phenoxyethoxy)propionitrile.

6. A process as claimed in claim 1, wherein the compound of the formula (1) is 3-[2'-(2''-phenoxyethoxy)ethoxy]propionitrile.

7. A process as claimed in claim 1, wherein the compound of formula (1) is 3-[2'-(phenylthio)ethoxy]propionitrile.

8. A process as claimed in claim 1, wherein the amount of the compound having the formula (1) used is from 0.5% to 10% by weight based on the total weight of the print paste or the pad liquor.

9. A process as claimed in claim 8, wherein the amount of the compound having the formula (1) used is from 1% to 5% by weight based on the total weight of the print paste or the pad liquor.

10. A process as claimed in claim 1, wherein the polyacrylonitrile textile fibres are polymeric or copolymeric acrylonitrile fibres which contains at least 80% by weight of acrylonitrile.

11. A process as claimed in claim 1 comprising printing textile polyacrylonitrile fibres at a temperature below the fixation temperature of the dyestuff with a printing paste which contains a cationic dyestuff, a thickener and a carrier consisting of at least one compound of the formula (1), removing excess paste from the impregnated polyacrylonitrile fibres and steaming and rinsing the resulting print.

12. A process as claimed in claim 1 comprising padding textile polyacrylonitrile fibres at a temperature below the fixation temperature of the dyestuff with a pad liquor which contains a cationic dyestuff and a carrier consisting of at least one compound of the formula (1), removing excess liquor from the impregnated polyacrylonitrile fibres and steaming and rinsing the resulting dyeing.

13. A process as claimed in claim 11 whenever the steaming is carried out at a temperature from 100° to 110°C.

14. A process as claimed in claim 12 whenever the steaming is carried out at atmospheric pressure.

* * * * *